US007134856B2

(12) United States Patent
Müller et al.

(10) Patent No.: US 7,134,856 B2
(45) Date of Patent: Nov. 14, 2006

(54) COMPRESSED AIR MOTOR

(75) Inventors: Thomas Müller, Langendorf (CH); Daniel Müller, Langendorf (CH); Kurt Müller, Langendorf (CH)

(73) Assignee: KMB Feinmechanik AG (CH)

( * ) Notice: Subject to any disclaimer, the term of this patent is extended or adjusted under 35 U.S.C. 154(b) by 6 days.

(21) Appl. No.: 10/503,173

(22) PCT Filed: Feb. 4, 2003

(86) PCT No.: PCT/IB03/00350

§ 371 (c)(1),
(2), (4) Date: Feb. 10, 2005

(87) PCT Pub. No.: WO03/067032

PCT Pub. Date: Aug. 14, 2003

(65) Prior Publication Data

US 2005/0129560 A1 Jun. 16, 2005

(30) Foreign Application Priority Data

Feb. 5, 2002 (CH) ..... 0196/02

(51) Int. Cl.
*F03C 2/00* (2006.01)
*F04C 18/00* (2006.01)

(52) U.S. Cl. ..... 418/259; 418/152; 418/173; 418/269

(58) Field of Classification Search ..... 418/173, 418/270, 152, 136, 140, 144, 259, 269, 236, 418/238

See application file for complete search history.

(56) References Cited

U.S. PATENT DOCUMENTS

| | | | | |
|---|---|---|---|---|
| 2,407,613 | A * | 9/1946 | Mann et al. | 418/76 |
| 3,417,664 | A * | 12/1968 | Brucker | 418/152 |
| 4,004,865 | A * | 1/1977 | Ikeda et al. | 418/45 |
| 4,120,623 | A * | 10/1978 | Lohn | 418/173 |
| 4,197,061 | A * | 4/1980 | Hill | 418/173 |
| 4,479,763 | A | 10/1984 | Sakamaki et al. | |
| 4,509,906 | A | 4/1985 | Hattori et al. | |
| 4,616,985 | A | 10/1986 | Hattori et al. | |
| 4,648,819 | A * | 3/1987 | Sakamaki et al. | 418/173 |
| 6,666,671 | B1 * | 12/2003 | Olver et al. | 418/173 |

FOREIGN PATENT DOCUMENTS

| | | |
|---|---|---|
| DE | 19744812 | 4/1999 |
| EP | 0339332 | 11/1989 |
| EP | 394651 B1 * | 8/1993 |
| GB | 1336128 | 11/1973 |
| JP | 59188081 | 10/1984 |
| JP | 61268892 | 11/1986 |

OTHER PUBLICATIONS

Int. Search Report.

* cited by examiner

*Primary Examiner*—Theresa Trieu
(74) *Attorney, Agent, or Firm*—Kaplan Gilman Gibson & Dernier LLP

(57) ABSTRACT

The invention relates to a compressed air motor comprising a housing and a rotor rotatably mounted therein, the rotor being provided with substantially radial slots and plate-like vanes being mounted in the slots so as to be radially displaceable by the centrifugal force, and variable, all-round air chambers being formed between the housing and the outside of the rotor. The vanes are surrounded on the outside by a rotatable sleeve which is provided with at least one passage for the compressed air.

13 Claims, 2 Drawing Sheets

COMPRESSED AIR MOTOR

BACKGROUND OF THE INVENTION

The invention relates to a compressed air motor comprising a housing having a guide bore and a rotor rotatably mounted therein, the rotor being provided with slots which run outwards and in which plate-like vanes are mounted so as to be radially displaceable by the centrifugal force, and a substantially cylindrical, freely rotatable sleeve which covers the outside of the vanes is arranged in the region of the vanes between the outside of the rotor and the guide bore of the housing.

The prior art recognizes various types of vane motors which are operated with compressed air. European Patent EP-B1-394651 describes a design comprising a rotor and vanes displaceable by centrifugal force, the rotor being arranged in a rotatable sleeve which is housed inside a bore of a housing.

This rotatable sleeve has the function of preventing the vanes from shearing against the inner surface of the housing. During operation, the rotor and the rotatable sleeve therefore rotate.

In this known design, the bore of the housing is not cylindrical but is non-cylindrically deformed on one side by a pocket. This is because it was evidently thought that feeding of compressed air into the space between the rotatable sleeve and the outer cylinder wall is required. Another reason is that the deformation on one side on the outside of the cylinder has presumably been required because there was also a tendency to lateral displacement of the rotatable sleeve due to the pressure load of the compressed air flowing axially into the space between the rotor and the rotatable sleeve, which lateral displacement could be compensated by the additional radial play in the recess.

The non-central formation of the bore in the housing results not only in greater manufacturing costs but also in an air loss during operation, which manifests itself in a low efficiency.

In U.S. Pat. No. 4,197,061, Boeing has disclosed a compressed air motor which manages without eccentric recesses in the housing bore but provides separate air-conveying channels on the inner surface of the housing which are supplied by means of compressed air and thus fill the space between the rotatable sleeve and housing with compressed air. The manufacture of these additional channels is, however, very complicated and interrupts the cylindrical formation of the housing bore, which can likewise lead to lower performance.

A further document of the prior art, U.S. Pat. No. 4,648,819 describes a pump which likewise has a rotatable sleeve. This rotatable sleeve is provided on its outside with various types of grooves which are intended to serve for conveying the medium to be pumped. The production of the grooves—extending partly over the circumference of the sleeves—on rotatable sleeves which themselves are composed only of a relatively thin-walled material is a relatively complicated measure. This known design gives no instructions at all regarding the manufacture of a compressed air motor.

U.S. Pat. No. 4,616,985 discloses a compressed air compressor which has vanes radially displaceable in a rotor and a sleeve surrounding said vanes and having orifices. The sleeve consists of a light metal alloy. The compressed air compressor has a relatively low speed and there therefore tends to be few problems with regard to wear.

The compressed air motors stated in the prior art and having a rotatable sleeve should—as already mentioned—in particular reduce the friction which occurs between the vanes and the outer housing in other compressed air motors and thus permit oil-free operation.

Particularly in the case of devices which are to be used in the area of surgery, it is important to be able to offer compressed air motors without oil lubrication, since no lubricating oil at all is permitted to enter the human body. Owing to their high speeds (up to about 80,000 rpm), compressed air motors used in surgery are difficult to seal in such a way that no leakage air losses and, associated therewith, oil emergence from the compressed air motor occur.

SUMMARY OF THE INVENTION

It is therefore the object of the invention to provide a compressed air motor which permits oil-free operation and has improved efficiency and the production of which is not to be particularly complicated.

By using a perforated rotatable sleeve or a rotatable sleeve provided with bores for passing through the wall, a surprisingly good mounting of the rotatable sleeve is achieved, both from the static point of view and from the point of view of little friction against the rotor vanes as well as against the inner surface of the outer housing. The cylindrical bore is easy to produce.

The air connections for air entry and air exit need not be formed in a particular manner in the system according to the invention, and they are preferably de-burred or sand-blasted in order further to improve the flow efficiency.

The rotor can be provided with vanes in an outward radial direction, but the vanes are preferably arranged in radial slots and not positively controlled. Preferably used material for the vanes and/or for the rotatable sleeve is plastic, in particular phenol resin/very fine cotton fabric.

The bores in the rotatable sleeve are optionally regularly distributed but may also be differently distributed according to requirements and depending on the construction length of the rotatable sleeve, or may be differently formed.

Thus, with regard to the noise-optimized behaviour of the rotatable sleeve, the bores are preferably statistically or randomly distributed, i.e. as far as possible no regular distances are present between the bores in the circumferential direction of the rotatable sleeve. This prevents the generation of dominant tones at the high speeds in the air medium. Thus, the passages in the rotatable sleeve may be one of: uniformly distributed over a circumference of the rotor; and non-uniformly distributed over the circumference of the rotor.

According to a particular embodiment, the bores may also be distributed in such a way that the bores deliberately generate complementary tones so that "white noise" (i.e. noise inaudible to the observer) results.

A noise-improving effect according to the type described above can also be achieved if the vanes are not distributed exactly symmetrically along the circumference of the rotor.

Regarding the formation of the bores (possibly slot-like), furthermore reference is made to U.S. Pat. No. 4,648,819 which has been mentioned and relates to a pump, since the grooves and groove shapes described there could, according to the invention, also be continuously formed in order to arrive at the effect according to the invention.

Furthermore, it is expedient if the longitudinal slots for the vanes are arranged offset approximately parallel to the radial planes. This results in the area supplied with the compressed air being larger than in the case of radially arranged vanes.

Four vanes are preferably provided, but the invention is not limited thereto and, depending on the diameter and on the choice of material, more or less vanes may also be provided.

The Patent Claims are to be interpreted in a correspondingly broad manner.

DESCRIPTION OF FIGURES

The invention is explained in more detail by way of example with reference to the drawings. The working example described corresponds to a preferred embodiment.

The list of reference numerals and FIG. 1 and FIG. 2, together with the objects described or protected in the Claims, form integral parts of the disclosure of this Application. The figures are described in relation to one another and in an overlapping manner. Identical reference numerals denote identical components, and reference numerals with different indices indicate functionally identical components.

DETAILED DESCRIPTION OF THE INVENTION

Figure 2:
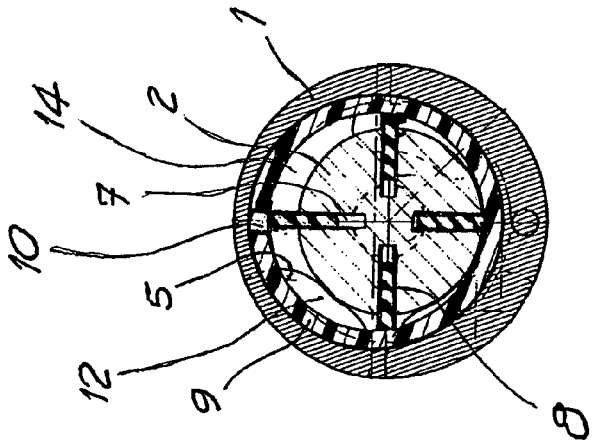
FIG. 2 shows a cross-section through the compressed air motor shown in FIG. 1, along the plane II—II.
Figure 1:
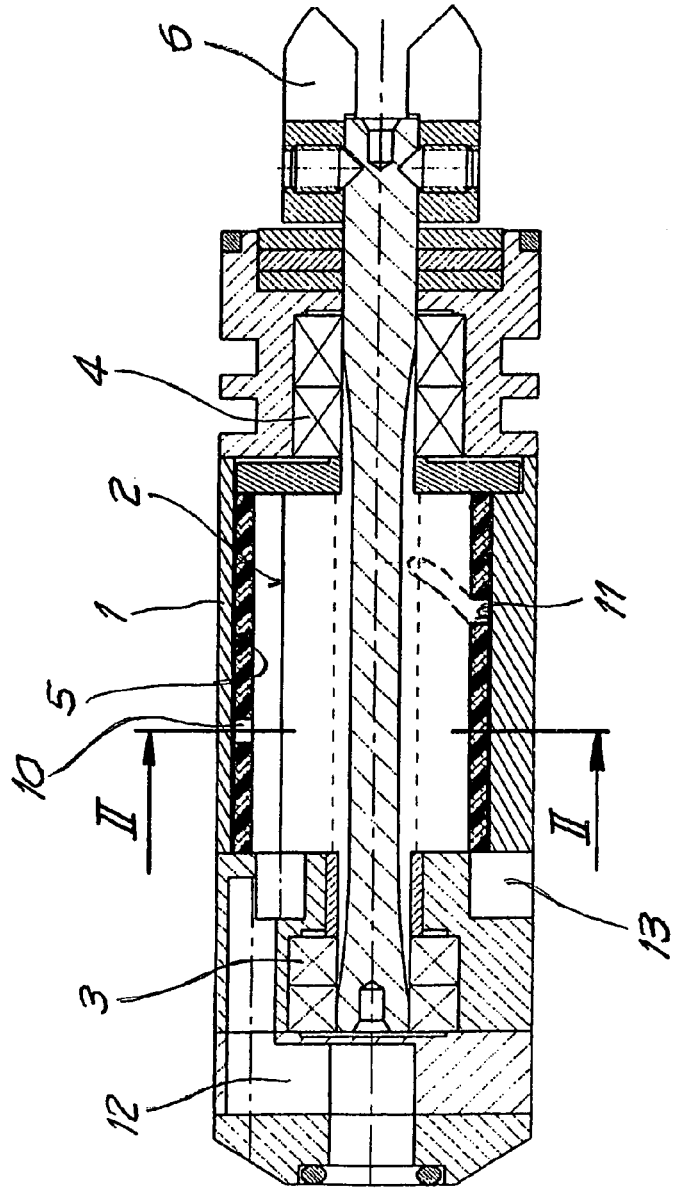
FIG. 1 shows a longitudinal section through a compressed air motor according to the invention.

The compressed air motor shown in FIG. 1 and 2 consists substantially of a multi-part housing denoted as a whole by 1. A rotor 2 is rotatably mounted by means of bearings 3, 4 in the housing 1. The middle region of the housing 1 has a substantially cylindrical guide bore 5. A tool receptacle 6 is present at the front end of the rotor 2. The rotor 2 has four substantially radial longitudinal slots 7. Vanes 8 are guided in a radially displaceable manner in the longitudinal slots 7. A rotatable sleeve 9 surrounds the outer end face of the vanes 8 and is mounted in the guide bore 5 of the housing 1 so as to be freely rotatable. The rotatable sleeve 9 rotates with the rotor 2 in the housing 1, the rotatable driving between the rotor 2 and the rotatable sleeve 9 being effected only by means of friction between the vanes 8 and the rotatable sleeve 9. The rotatable sleeve 9 prevents the vanes 8 from coming into contact with the guide bore 5 and therefore also associated wear phenomena of the vanes 8 and of the guide bore 5. The compressed air is supplied via a feed channel 12 which opens into the guide bore 5 at the rear end face of the rotor 2. The air exit 13 is located on that side which is approximately radially opposite the feed channel 12.

The rotatable sleeve 9 is provided with passages 10, 11. These passages 10, 11 serve for the passage of the compressed air from the chambers 14 formed between the vanes 8, the outside of the rotor 2 and the inside of the rotatable sleeve 9. As a result of the passage of a part of the compressed air, an air cushion is likewise built up on the outside of the rotatable sleeve 9. This prevents the rotatable sleeve 9 from pressing against the bore of the housing 1 on one side as a result of the internal pressure and consequently prevents major wear between the rotatable sleeve 9 and the housing 1. The passages 10, 11 can, for example, be in the form of bores or of slots, one or more of which slots may be substantially helical. The passages 10, 11 are preferably arranged offset axially and/or radially relative to one another. In fact, this offsetting of the passages can have a positive influence on the sound waves generated at high speeds (up to about 80,000 rpm) customary in such devices.

Figure 3:
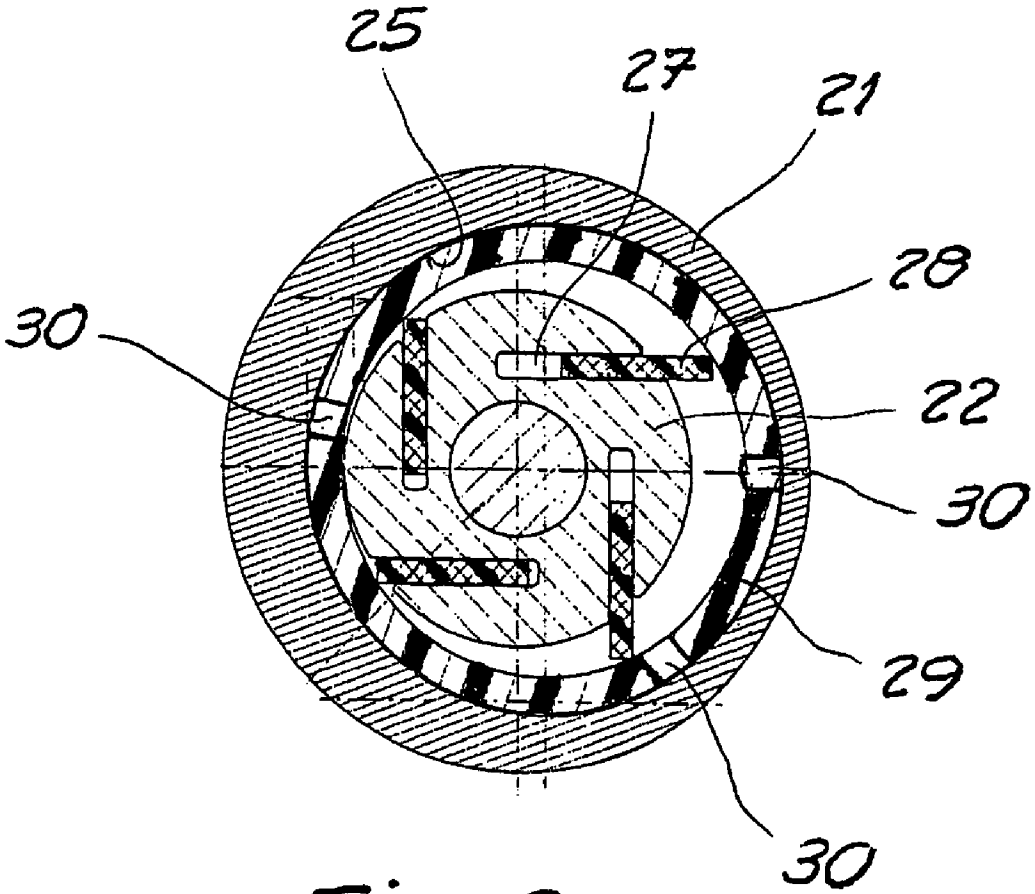
FIG. 3 shows a cross-section, corresponding to FIG. 2, through a further embodiment of the compressed air motor according to the invention.

The vanes 8 and/or the rotatable sleeve 9 can preferably be produced from a plastic, in particular phenol resin/very fine cotton fabric. This results on the one hand in a low weight and, associated therewith, a small centrifugal mass, so that such compressed air motors can be operated in a very dynamic manner, i.e. with considerable speed change. The cross-section shown in FIG. 3 through a further embodiment of a compressed air motor according to the invention shows a housing 21 and a rotor 22.

The housing 21 has a guide bore 25. The rotor 22 is provided with longitudinal slots 27 which however, in contrast to the embodiment shown in FIG. 2, are not radial but are arranged in a plane offset parallel to the radial plane. Vanes 28 are likewise displaceably mounted in the longitudinal slots 27. A rotatable sleeve 29 surrounds the outside of the vanes 28 and is mounted in the guide bore 25 of the housing 21. The rotatable sleeve 29 is provided with at least one passage 30. Compressed air can enter the annular gap between the housing 1 and the rotatable sleeve 29 through the passage 30. This produces a sort of air cushion which causes the rotatable sleeve 29 to be lifted off the guide bore 25 of the housing 21, and hence wear phenomena are avoided. The passage 30 can be arranged axially and/or radially at different points of the rotatable sleeve 29. It is also possible to provide a plurality of orifices along the circumference of the rotatable sleeve, it being possible for the passages to be, for example, in the form of bores or in the form of slots. Both the rotatable sleeve 29 and the vanes 28 preferably consist of a plastic, for example phenol resin/very fine cotton fabric.

LIST OF REFERENCE NUMERALS

1 Housing
2 Rotor
3 Bearing
4 Bearing
5 Bore
6 Tool receptacle
7 Longitudinal slot
8 Vane
9 Rotatable sleeve
10 Orifice
11 Orifice
12 Feed channel
13 Air exit
21 Housing
22 Rotor
25 Bore
27 Longitudinal slot
28 Vane
29 Rotatable sleeve
30 Orifice

The invention claimed is:

1. A compressed air motor, comprising:

a housing having a guide bore;

a rotor rotatably mounted in the guide bore, the rotor having: (i) slots running in an outward direction, and (ii) plate-like vanes mounted on the rotor so as to be displaceable outwards by a centrifugal force; and a freely rotatable sleeve arranged in a region between an outside of the rotor and the guide bore of the housing, wherein the rotatable sleeve has at least one passage in a lateral surface thereof for compressed air and at least one of the rotatable sleeve and the vanes consist of plastic, wherein at least one of the rotatable sleeve and the vanes comprise phenol resin and a fine cotton fabric.

2. The compressed air motor according to claim 1, wherein one of: the at least one passage is in the form of a substantially radial bore, and the at least one passage is in the form of a slot.

3. The compressed air motor according to claim 2, wherein one of:

the at least one passage runs substantially in a longitudinal direction of the rotatable sleeve; and the at least one passage is substantially helical.

4. The compressed air motor according to claim 1, wherein the rotatable sleeve includes a plurality of passages distributed regularly at least one of along a circumference and over a length thereof.

5. The compressed air motor according to claim 4, wherein one of:

the passages are in the form of substantially radial bores, and the passages are in the form of slots.

6. The compressed air motor according to claim 5, wherein one of:

the slots run substantially in a longitudinal direction of the rotatable sleeve; and the slots are substantially helical.

7. The compressed air motor according to claim 4, wherein the rotatable sleeve includes a plurality of passages distributed irregularly at least one of along a circumference and over a length thereof.

8. The compressed air motor according to claim 7, one of:

the passages are in the form of substantially radial bores, and the passages are in the form of slots.

9. The compressed air motor according to claim 8, wherein one of:

the slots run substantially in a longitudinal direction of the rotatable sleeve; and the slots are substantially helical.

10. The compressed air motor according to claim 1, wherein the rotatable sleeve includes a plurality of passages that are one of: uniformly distributed over a circumference of the rotor; and non-uniformly distributed over the circumference of the rotor.

11. The compressed air motor according to claim 1, wherein the longitudinal slots of the vanes are arranged offset approximately parallel to radial planes thereof.

12. The compressed air motor according to claim 1, wherein about two to six vanes are provided.

13. The compressed air motor according to claim 1, wherein four vanes are provided.

* * * * *